US005805040A

United States Patent [19]

Corcoran

[11] Patent Number: 5,805,040

[45] Date of Patent: Sep. 8, 1998

[54] RELAY BASE AND METHOD OF ASSEMBLY

[75] Inventor: John Joseph Corcoran, Oakland City, Ind.

[73] Assignee: Simens Electromechanical Components, Inc., Princeton, Ind.

[21] Appl. No.: 722,821

[22] Filed: Sep. 27, 1996

[51] Int. Cl.[6] ..... H01H 9/02; H01H 13/04

[52] U.S. Cl. ..... 335/202; 335/78; 335/129

[58] Field of Search ..... 335/78–86, 129, 335/130, 202

[56] References Cited

U.S. PATENT DOCUMENTS 4,254,391 3/1981 Gould ..... 335/119
4,320,369 3/1982 Bukala ..... 335/202
5,202,663 4/1993 Tomono et al. ..... 335/86
5,289,144 2/1994 Liao ..... 335/78
5,396,204 3/1995 Matsuoka et al. ..... 335/78

*Primary Examiner*—Michael L. Gellner
*Assistant Examiner*—Raymond Barrera
*Attorney, Agent, or Firm*—Donald B. Paschburg

[57] ABSTRACT

An improved relay includes a base (20) integrally molded defining a pair of notches (24) for matingly receiving a mounting structure (26) comprised by a motor assembly (10) of the relay, so as to determine the relative positions of the motor assembly (10) and the base (20) with a high degree of reliability. The other components of the relay are similarly secured in corresponding predetermined positions by fitting within other mounting structures molded into the base member (20).

11 Claims, 2 Drawing Sheets

RELAY BASE AND METHOD OF ASSEMBLY

FIELD OF THE INVENTION

This invention relates to an improved relay, and a method of assembly thereof.

BACKGROUND OF THE INVENTION

Relays have been in use for many years. Essentially, a relay comprises a coil energized by a control current to move an armature. When the armature moves, a moving contact connected by a moving terminal to an external circuit is moved from its normal position to its actuated position. The motion of the armature may move more than one contact. Both normally-closed and normally-open contacts are typically provided with respect to each of the moving contacts.

Such relays, being industrial products of wide applicability, are always susceptible to improvements in manufacturing, specifically those providing reduction in cost. Reduction in cost can be achieved by simplification of the manufacturing process, reduction in parts count, and the like.

The present invention is directed particularly to improvements in printed circuit board relays, that is, relatively small relays carrying relatively small currents, the contacts of which are connected to the associated control and controlled circuits by connecting pins inserted directly into holes in a circuit board and soldered to conductors disposed thereon.

OBJECT OF THE INVENTION

It is an object of the present invention to provide an improved method of assembling a relay, involving fewer parts and a more reliable assembly technique than was possible in the prior art, and the improved relay produced thereby.

SUMMARY OF THE INVENTION

These objects of the invention are met by the inventive method of assembling a relay, and the relay produced thereby, wherein the motor assembly of the relay is conveniently located and securely fixed to the base of the relay, and thereby with respect to the other components of the relay. Mounting members integral with the motor assembly are matingly received by and secured to mounting structure molded integrally with the base.

BRIEF DESCRIPTION OF THE DRAWINGS

The invention will be better understood if reference is made to the accompanying drawings, in which.

DESCRIPTION OF THE PREFERRED EMBODIMENTS

Figure 1:
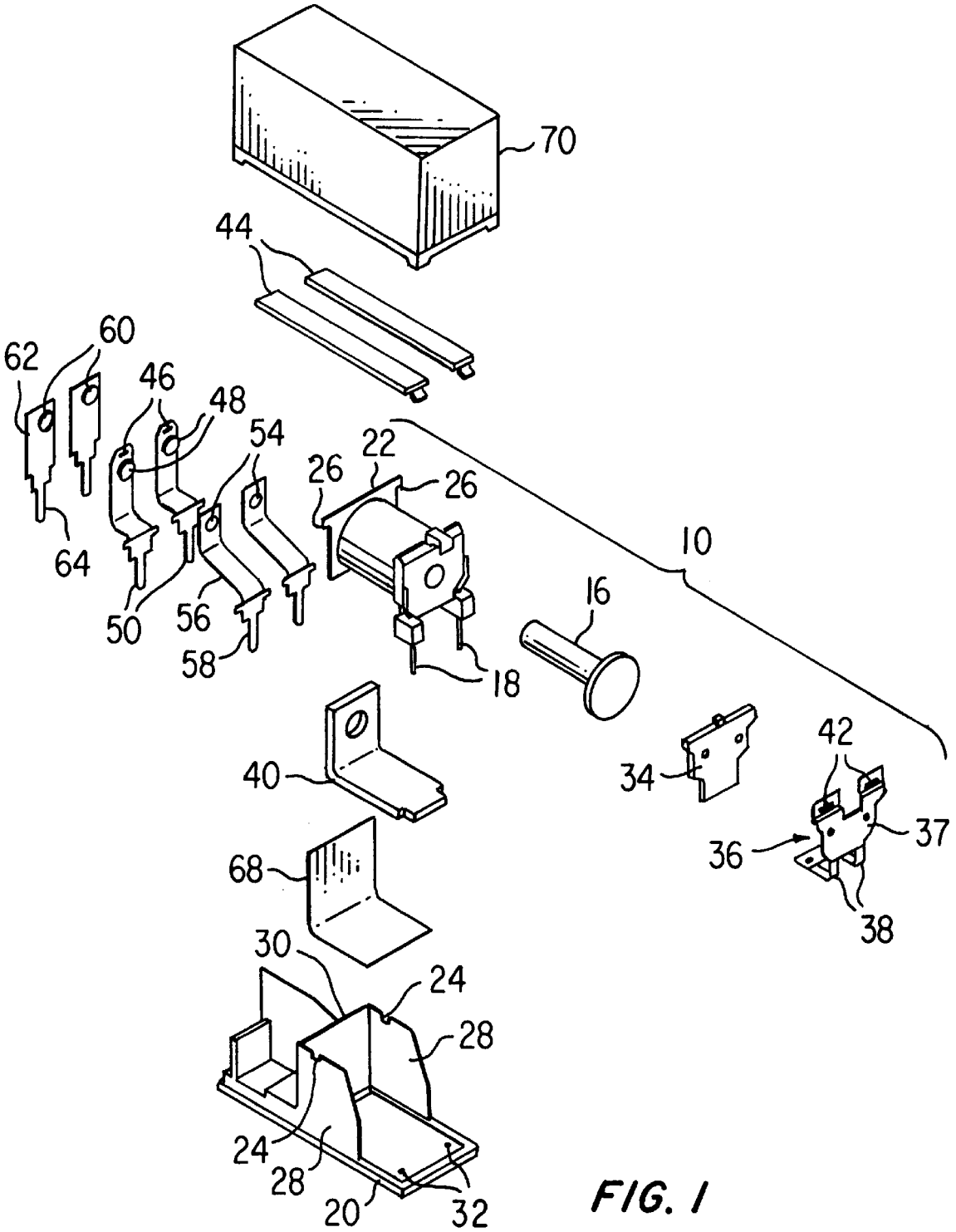
FIG. 1 is an exploded view of a first embodiment of a relay according to the invention.

The essential components of a relay according to the invention are shown in FIG. 1. Numerous components of the relay shown in FIG. 1 are shown in further detail in FIGS. 2 and 3. The differences between the embodiments of FIG. 1 and that of FIGS. 2 and 3 relate principally to the method whereby the motor assembly is located with respect to the base member. These differences will be discussed in detail below.

The relay according to the invention includes a motor assembly 10. Motor assembly 10 includes a bobbin 12 (see FIG. 3), a coil winding 14 wound thereover, and a pole piece 16 extending through the core of the bobbin 12. Leads from the coil winding 14 are connected to two connecting pins 18 which extend through holes molded in a base 20. Connecting pins 18 thus determine the location of at least one end of the motor assembly 10 with respect to base 20.

According to an important aspect of the invention, motor assembly 10 also comprises a mounting member in predetermined fixed relation to the bobbin, received by mating structure formed integrally with the base. In the embodiment of FIG. 1, base 20 comprises a pair of notches 24 for receiving ears 26 formed in a flanged mounting member 22 of the motor assembly. As can be seen in FIG. 1, notches 24 are formed in two upstanding walls 28 molded integrally with the base 20. Walls 28 are joined for rigidity by rear wall 30, also molded integrally with base 20. Walls 28 and 30 also provide insulation between the relay contacts and the coil 14.

The motor assembly 10 also includes an armature 34 staked or riveted to a return spring 36. Return spring 36 comprises a unitary member of a spring material, stamped and formed to comprise two leg members 38 staked to motor frame 40, in turn secured to structure molded in base 10, and thus defining the position of the assembly of the return spring 36 and armature 34 with respect to the other components of the relay. Return spring 36 has slots 42 (as shown) or other means for being readily assembled to two pusher rails 44 formed in its upper extremity. The opposite ends of pusher rails 44 abut bearing surfaces formed on terminals 46 carrying moving contacts 48. Terminals 46 are spot welded, soldered, or otherwise secured to connecting pins 50 extending through the base 20.

Figure 2:
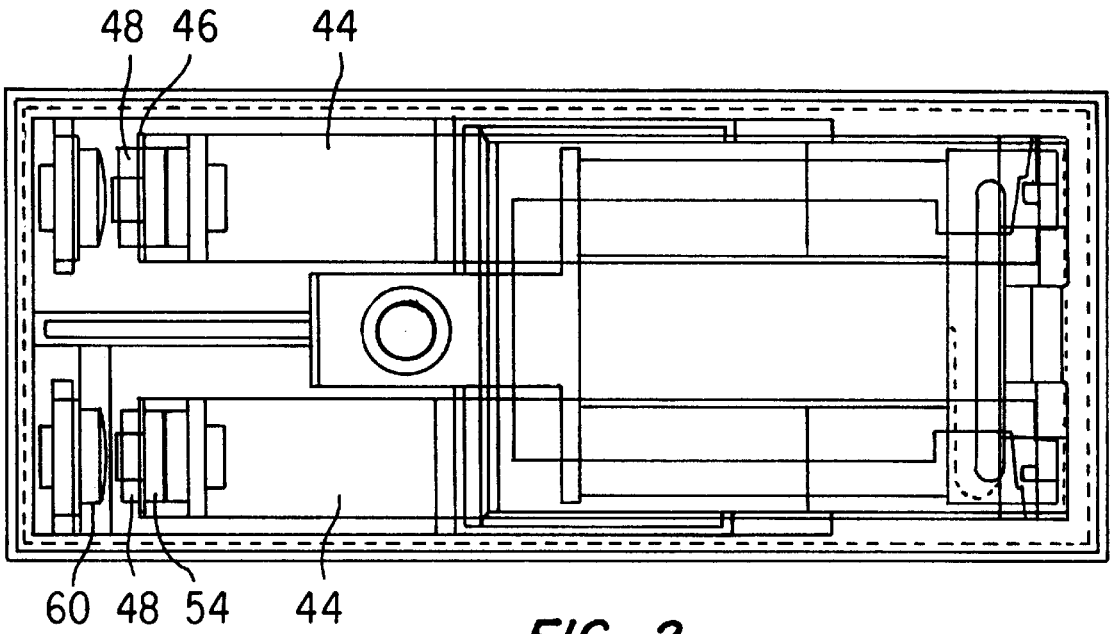
FIG. 2 is a plan view of a second embodiment of a relay according to the invention.
Figure 3:
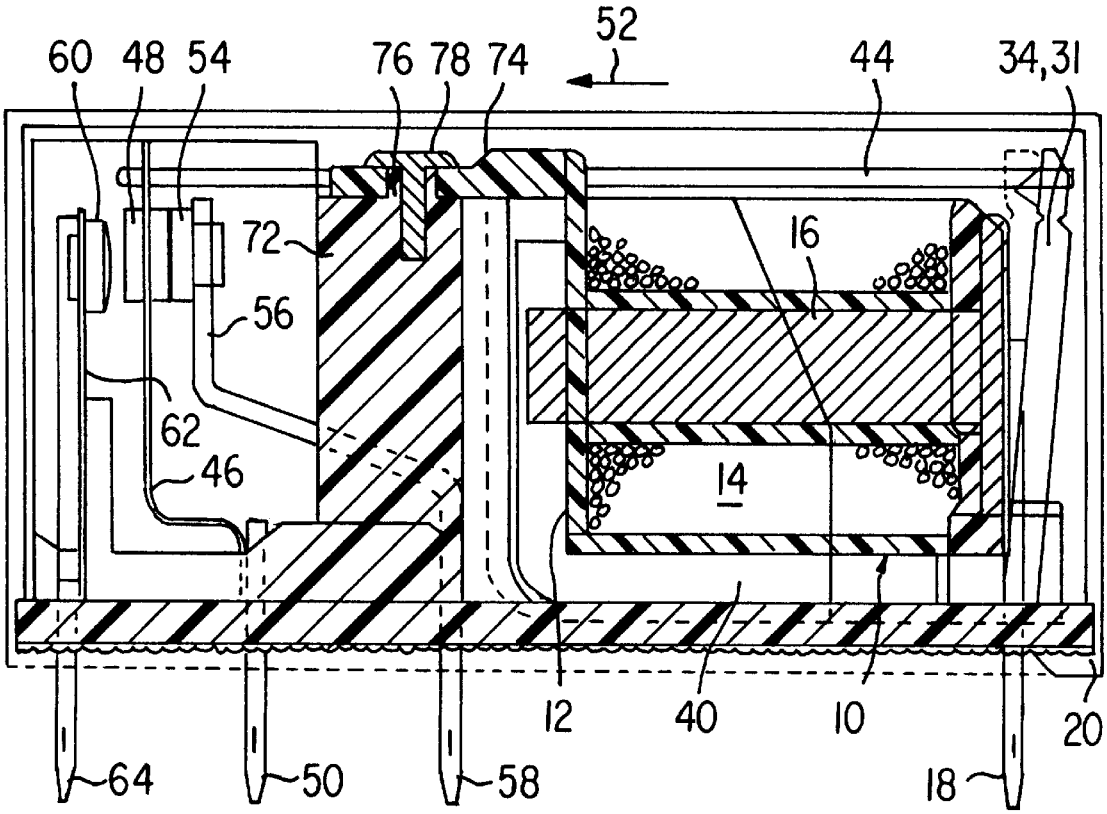
FIG. 3 is an elevational view, partly in cross-section, of the relay of FIG. 2.

Accordingly, when a control current is applied to the coil winding 14 via pins 18, a magnetic field is generated in pole piece 16. The magnetic field attracts armature 34 and return spring 36 toward pole piece 16, that is, leftward in the diagram of FIGS. 2 and 3, as indicated by arrow 52. Pusher rails 44 are accordingly moved leftward by return spring assembly 36, and move the moving contacts 48 from their normal position, in which they are shown in FIGS. 2 and 3, to their actuated position. In their normal position, moving contacts 48 abut normally closed contacts 54 mounted on terminals 56 and connected to external circuit elements by connecting pins 58. In their actuated position, moving contacts 46 instead abut normally open contacts 60, which are similarly supported by terminals 62 having connecting pins 64 extending through base 20.

The assembly of the relay shown in FIG. 1 is completed by frame 40 which supports the coil assembly, a Mylar or other plastic insulating member 68, and a cover 70.

It will be appreciated by examination of FIG. 1 that when motor assembly 10 is assembled to the base 20, connecting pins 18 extend through holes 32 in the base and may be secured thereto by epoxy cement, by an other adhesive, or by heat sealing or the like. At the same time, ears 26 are matingly received within notches 24 and can similarly be secured permanently thereto by epoxy cement, heat sealing or the like. Motor assembly 10 is thus conveniently received by and secured to base 20 in its proper position. The principal active components of the relay, i.e., the moving and fixed contacts, and the armature and return spring assembly, are similarly secured to base 20, that is, by being received within and secured to mounting structure molded integrally with base 10. The pusher rails may additionally be guided by structure molded into the base 20. As all the operational components of the relay are thus secured to mounting structure molded integrally with base 20, the components are reliably positioned with respect to one another.

As mentioned above, in the embodiment of FIG. 1 the position of motor assembly 10 is fixed with respect to the base 20 (and thus to the remaining components of the relay) by a pair of ears 26 received within and secured to a pair of notches 24 formed integrally with base 20. The cooperation between the ears 26 and notches 24 ensures that the motor assembly 10 is disposed in a predetermined physical position on the base 20. After assembly, the motor assembly 10 can be secured in its proper position by adhesive bonding of the ears to the notches by heat sealing thereof or the like.

Other methods of reliably and efficiently assembling the motor assembly to the base and securing it thereto are within the scope of the invention. The cooperating ears and notches of FIG. 1 could be replaced by a variety of protruding members on one of the motor assembly and base similarly cooperating with receptacles on the other. Protruding members on the motor assembly and receiving structure on the base could be designed such that assembly of the motor assembly requires structure on the base, e.g., opposed walls 28, to be sprung temporarily apart to permit insertion of the motor assembly; this structure would then spring back when the protruding members reached their corresponding receptacles. A "snap-fit" assembly would thus be provided.

Other possibilities include that shown in FIGS. 2 and 3, wherein a post 72 is molded integrally with base 20. Post 72 extends generally perpendicular to the plane of the base for mating with a flange 74 extending from the motor assembly parallel to the base. The relative positions of the post 72 and flange 74 are determined by an upstanding central portion 76 of post 72 received within a corresponding hole in flange 74; the flange can then be secured to the post by a pin 78 which is an interference fit in a hole in the post 72. The post could also comprise a portion extending above the flange and staked, adhesively-bonded, or heat sealed thereto, or the like.

Numerous further expedients are within the scope of the invention for fixing the relative physical position of the motor assembly with respect to the base and conveniently securing the two together. For example, the mounting structure formed on the motor assembly might comprise a pin received within a mating hole molded in the base, or a tongue on the motor assembly received between a pair of fingers or the like integrally molded on the base. Similarly, the ears and notches shown in FIG. 1 can conveniently be multiplied for additional strength and security of the assembly.

In each case, a mounting member forming an integral part of the motor assembly is matingly received by means molded integrally with the base, so as to insure that the motor assembly is fixed in a predetermined position with respect to the base. When the other components of the relay are similarly fixed to the base by other cooperative mating structures molded integrally with the base, the relative physical positions of the components of the relay are predetermined with a high degree of reliability. As the injection molding process used to form the base is a highly accurate and reproducible process, and as the base is molded to include mounting structures for all the principal components of the relay, these components will thereby be very precisely located with respect to one another, ensuring reliable product assembly.

Therefore, while a preferred embodiment of the invention has been described in detail, the invention should not be limited by the above exemplary disclosure, but only by the following claims.

What is claimed is:

1. A relay, comprising:

a motor assembly, comprising a bobbin, a coil winding wound over said bobbin, a pole piece in a bore extending through said bobbin, a mounting member in predetermined fixed relation to said bobbin, and an armature, adapted to be urged toward said pole piece when an activating current is passed through said coil, said mounting member of said motor assembly including a pair of protruding members on opposite sides of said bobbin, at least one contact movable between normal and actuated positions responsive to motion of said armature, at least one fixed contact for being contacted by said movable contact in either said normal or said actuated position thereof, a molded plastic base for receiving said motor assembly and said at least one movable contact and said at least one fixed contact having a fixed spatial distance therebetween in predetermined physical relation to one another when assembled and adjustable to either the actuated or normal position therebetween during operation, said base including a generally planar bottom portion and a pair of spaced substantially parallel vertical walls molded integrally therewith, said motor assembly being received between said walls, said base further including integrally-molded means for matingly receiving said mounting member of said motor assembly, so that said motor assembly is disposed in predetermined relation to said base, said means for matingly receiving including receptacles molded into said base for receiving said protruding members, said receptacles being formed in upper edges of said walls for receiving said protruding members, means for securing said mounting member of said motor assembly to said means for matingly receiving molded integrally with said base, said means for securing including means for bonding said protruding members into said receptacles and, a back wall extending between said spaced parallel walls and molded integrally therewith, said back wall and said spaced parallel walls extending to about a same height.

2. The relay of claim 1, wherein said protruding members are adhesively bonded into said receptacles.

3. The relay of claim 1, wherein said protruding members are heat-bonded into said receptacles.

4. The relay of claim 1, wherein said at least one contact movable between normal and actuated positions responsive to motion of said armature is actuated by at least one pusher rail moved by motion of said armature and transferring force from said armature to said movable contact.

5. The relay of claim 4, wherein a return spring is mounted to said base, said armature being assembled to said return spring such that said return spring is moved by said armature upon supply of current to said coil, one end of said pusher rail being pivotally connected to said return spring.

6. The relay of claim 1, wherein two movable contacts are provided, and two normally-open and two normally-closed contacts are also provided.

7. The relay of claim 1, wherein said motor assembly further comprises two connector pins connected to said coil winding, said pins extending through holes molded into said base.

8. The relay of claim 1, wherein said movable and fixed contacts each comprise connector pins extending through holes molded into said base.

9. A method of assembling a relay, comprising the steps of:

providing a motor assembly, comprising a bobbin, a coil winding wound over the bobbin, a pole piece in a bore extending through the bobbin, an armature, and a mounting member in predetermined fixed relation to the other components of said motor assembly, said mounting member of said motor assembly including a pair of protruding members on opposite sides of said bobbin, providing at least one terminal having secured thereto at least one moving contact, providing at least one fixed contact, molding a plastic base to comprise integrally-molded structure for receiving each of said motor assembly, said at least one terminal having secured thereto at least one moving contact, and said at least one fixed contact in predetermined physical relation to one another said at least one moving contact, and said at least one fixed contact having a fixed spatial distance therebetween when assembled and the spatial distance being adjustable to either an actuated position or a normal position therebetween during operation, and said structure further including integrally-molded means for matingly receiving said mounting member of said motor assembly, so that said motor assembly is disposed in predetermined relation to said base, said base including a generally planar bottom portion and a pair of spaced substantially parallel vertical walls molded integrally therewith, said motor assembly being received between said walls, said means for matingly receiving including receptacles molded into said base for receiving said protruding members, said receptacles being formed in upper edges of said walls for receiving said protruding members, and securing said motor assembly to said base by inserting said motor assembly between said walls and a back wall such that said mounting member is received by inserting said protruding members into said receptacles, said walls and said back wall extending about a same height from said base, mounting said at least one terminal having secured thereto at least one moving contact to said base so as to be movable between normal and actuated positions responsive to motion of said armature, and mounting said at least one fixed contact to said base so as to be contacted by said movable contact in either said normal or said actuated position thereof.

10. The method of claim 9, wherein said protruding members are adhesively bonded into said receptacles.

11. The method of claim 10, wherein said protruding members are heat-bonded into said receptacles.

* * * * *